US006303204B2

(12) United States Patent
Mathieson

(10) Patent No.: US 6,303,204 B2
(45) Date of Patent: Oct. 16, 2001

(54) EARTHEN LINER WITH CLAY SEAM COVER

(75) Inventor: Michael C. Mathieson, Kingwood, TX (US)

(73) Assignee: GSE Lining Technology, Inc., Houston, TX (US)

( * ) Notice: Subject to any disclaimer, the term of this patent is extended or adjusted under 35 U.S.C. 154(b) by 0 days.

(21) Appl. No.: 09/749,117

(22) Filed: Dec. 27, 2000

Related U.S. Application Data

(62) Division of application No. 09/444,892, filed on Nov. 22, 1999, now Pat. No. 6,197,398.

(51) Int. Cl.[7] ..... B32B 3/10
(52) U.S. Cl. ..... 428/61; 428/57; 405/270
(58) Field of Search ..... 428/57, 58, 61; 52/169.14; 405/270; 588/250

(56) References Cited

U.S. PATENT DOCUMENTS 4,693,923 * 9/1987 McGroarty et al. ..... 428/148
5,360,294 11/1994 Carriker et al. .

FOREIGN PATENT DOCUMENTS 0 449 182 A2 10/1991 (EP) .
91 10 502.1 10/1991 (DE) .

OTHER PUBLICATIONS

Partial Translation of German Patent Document DE 91 10 502.1 Dated Oct. 31, 1991, pp. 5–13.

* cited by examiner

*Primary Examiner*—Alexander S. Thomas
(74) *Attorney, Agent, or Firm*—Trop, Pruner & Hu, P.C.

(57) ABSTRACT

A geosynthetic liner may be formed of sheets of substantially liquid impermeable synthetic material such as high density polyethylene. The adjacent edges of adjacent sheets may be lapped over one another to form a lapped joint. The lapped joint may be covered by a relatively narrow seam cover which seals the region between the two sheets. The cover may be formed of a geomembrane layer over a clay layer. The clay layer may be formed of particles of bentonite which are adhesively secured to the geomembrane layer. Thus, the geomembrane liner seam may be sealed by simply unrolling the cover over the lapped joint and covering the sheets and the cover with a layer of overburden.

12 Claims, 2 Drawing Sheets

EARTHEN LINER WITH CLAY SEAM COVER

This is a divisional of prior application Ser. No. 09/444,892 filed Nov. 22, 1999 U.S. Pat. No. 6,197,398.

BACKGROUND

This invention relates generally to membrane or sheet liners which may be used, for example, to line containment structures, such as landfills for hazardous or non-hazardous waste disposal, water or other fluid containments or to cover such containments to prevent the encroachment of storm water or the escape of odors and fumes.

Conventionally, earthen structures or natural depressions form the containment volume. Substantially impermeable membrane sheets are then utilized to reduce or minimize leakage of the contained material. These substantially impermeable sheets are frequently described as "geomembranes".

The size and/or geometry of the containment may require that a multiplicity of membrane sheets be used to cover the total area to be protected from excessive leakage. As a result a number of seams between edges of adjacent membrane sheets must be sealed to assure the desired reduction of containment leakage.

The edges of adjoining membrane sheets may be heat fused and thereby sealed and joined together in a leakproof fashion. Alternatively, adhesives or chemicals that fuse adjoining edges together may be used-to join and seal the edges of some types of membranes.

Forming an adequately effective, leak resistant containment membrane seal is labor intensive and requires significant skills, training, tools, supplies and equipment. Commonly used sealing procedures may be adversely affected by moisture and inclement weather.

Thus, there is a need for an effective, suitably leak resistant seam that reduces the disadvantages of the current practices.

SUMMARY

In accordance with one aspect, a geosynthetic liner includes substantially liquid impermeable first and second liner sheets. A lapped region is defined wherein a portion of the first liner sheet overlaps a portion of the second liner sheet. A seam cover is positioned over the lapped region. The cover includes a layer of clay and a geomembrane layer over the clay layer.

Other aspects are set forth in the accompanying detailed description and claims.

DETAILED DESCRIPTION

Figure 1:
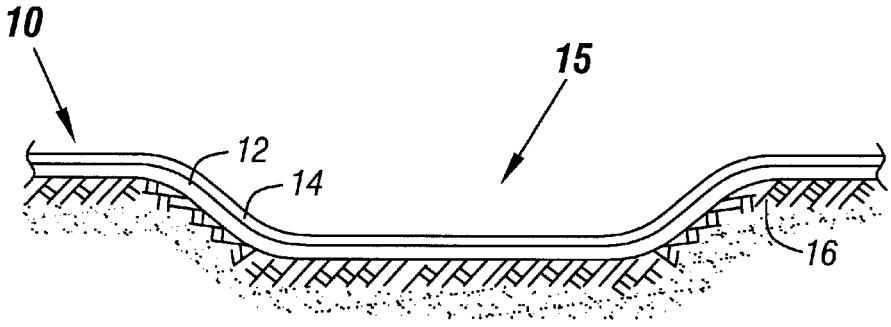
FIG. 1 is a cross-sectional view of a liner in accordance with one embodiment of the present invention.
Figure 4:
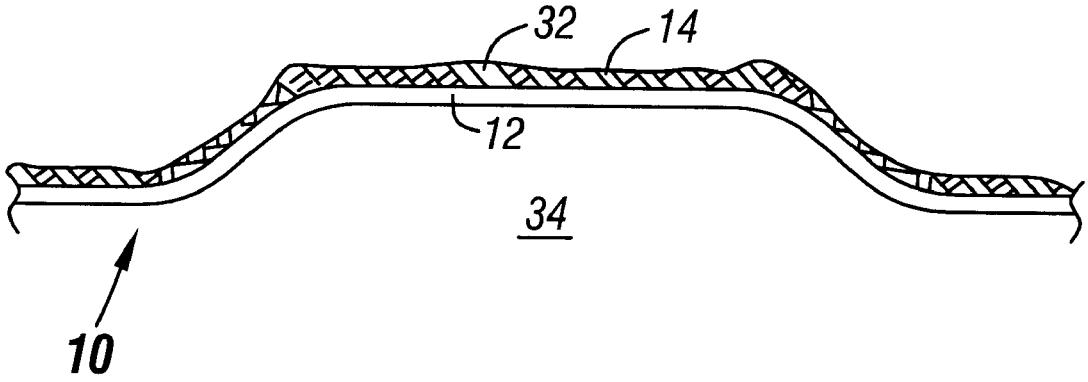
FIG. 4 is a cross-sectional view of a liner in accordance with another embodiment of the present invention.

A geosynthetic liner 10, shown in FIG. 1, may be formed in a void 15 in the earth 16. The void 15 may be natural or may be man-made for example by digging a hole or forming an encircling berm. In another embodiment, shown in FIG. 4, a liner 10 may form a cap or cover over an area, such as a landfill 34, that protrudes upwardly as indicated at 32.

A substantially liquid impermeable layer 12 may be formed of a substantially liquid impermeable material such as high density polyethylene (HDPE). A number of plastic barrier materials are well known for forming liners in earthen containments for reducing or eliminating leakage.

A material (not shown) may be contained within the void 15 formed by the liner 10. The material may be waste material as is common in waste containment areas or landfills. In other embodiments, the liner 12 may contain a liquid such as water for storage purposes. Those skilled in the art will appreciate that there are a wide variety of uses for substantially liquid impermeable geosynthetic liners.

The liner 10 may be covered by overburden 14. The overburden may be relatively loose soil which has been deposited over the liner after the liner is installed. However, other material, including waste material, may be used as overburden.

Figure 2:
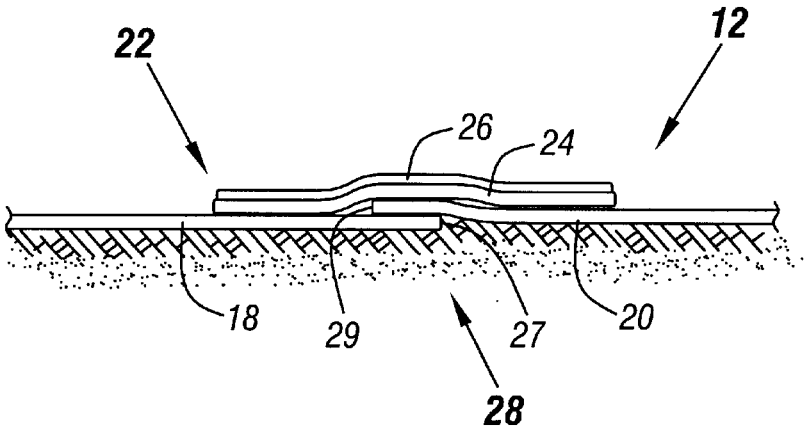
FIG. 2 is an enlarged cross-sectional view through a portion of the liner shown in FIG. 1.

The liner 10 may be formed from a plurality of elongate sheets of substantially liquid impermeable material. Adjacent sheets, such as the sheets 18 and 20, may be lapped one on top of the other to form a lapped joint 28, as shown in FIG. 2. The joint 28 includes lapped sheet edges 27 and 29. Conventionally, lapped joints are heat sealed using a welding technique such as wedge welding.

However, in accordance with one embodiment of the present invention, at least one of the joints 28 is sealed by overlaying an elongate geosynthetic clay liner (GCL) cover or strip 22. The strip 22 may include an upper substantially liquid impermeable membrane layer 26 which may be made of high density polyethylene as one example. Adhered to the layer 26 is a clay layer 24, for example containing sodium bentonite clay material and adhesive. The adhesive may adhesively secure the clay layer 24 to the layer 26. When exposed to liquid, the layer 24 hydrates and forms a substantially liquid tight, leak resistant seal to the underlying sheets 18 and 20. In one embodiment of the present invention, the strip 22 may have a permeability of less than $4\times10^{-14}$ m/sec.

Thus, by simply positioning the strip 22 atop the joint 28, a substantially liquid tight seal may be achieved. The seal is not adversely affected by the presence of liquid on top of the sheets 18 and 20 prior to positioning the sealing strip 22. Thus, with one embodiment of the present invention, seaming may be undertaken even in light rain or light snow conditions.

Figure 3:
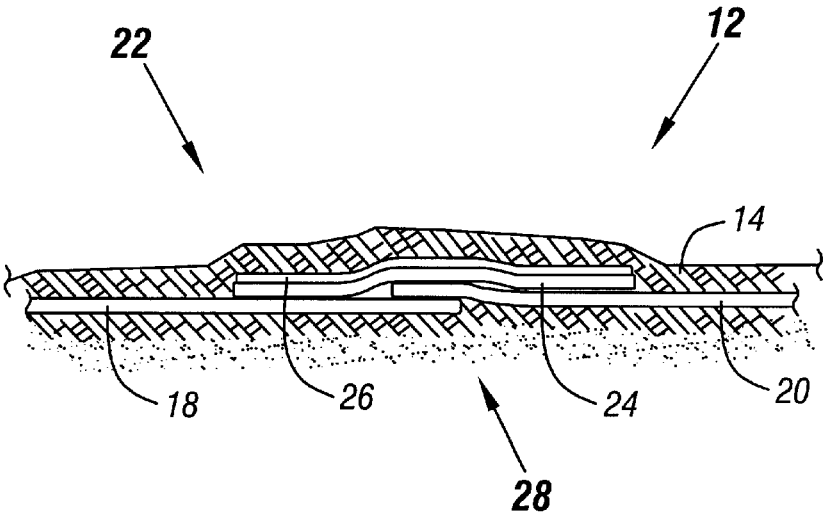
FIG. 3 is an enlarged cross-sectional view corresponding to FIG. 2 after overburden has been applied.

Referring now to FIG. 3, overburden 14 may be applied over the layer 12 to hold the strip 22 in position. Advantageously, the overburden 14, such as loose soil, is carefully applied so as not to disturb the positioning of the strip 22 with respect to the rest of the liner 10.

Advantageously, the strip 22 is formed of GundSeal® brand material available from GSE Lining Technology, Inc., Houston, Texas. The manufacturing of the material is described for example in U.S. Pat. No. 4,693,923 which is hereby expressly incorporated by reference. The clay layer 24 material may include non-hydrated montmorillonite (sodium bentonite) in accordance with one embodiment of the present invention. The clay may be initially composed of discrete clay particles. The surface of the layer 26 which contacts the clay layer 24 may be roughened to improve clay adhesion or friction at any interface with other materials.

The adhesive which secures the clay layer 24 to the layer 26 may be formed of a variety of adhesives. Suitable adhesives including asphalt with or without fillers and elastomers, butylene, butyl rubber, acrylic, propene, styrene/butadiene, nitrile, vinyl, water soluble cellulosic, saccharides, gums or proteins.

In accordance with one embodiment of the present invention, the adhesive solids are present in concentrations from about 5 to about 100 percent by weight and are mixed with bentonite in ratios between 3 and 50 percent by weight of adhesive relative to the bentonite particles. One pound of sodium bentonite may be applied per square foot of geomembrane layer 26, in accordance with one embodiment. The layer 26 may be from 0.3 to 2 mm. in thickness as examples. The montmorillonite content may be at least 90% and the fluid loss (ASTM D5891) may be less than 18 ml. The free swell (ASTM D5890) may be more than 24 ml.

The strip 22 may be formed in rolls and may simply be unrolled over the joint 28. A section at the end of a roll of the strip 22 may be lapped over a section at the beginning of the next roll.

In accordance with one example of the present invention, the lap joint 28 may be of a width of about four to six inches. The strip 22 may be of a width on the order of three to four feet. Thus, in some advantageous embodiments of the present invention, the width of the strip 22 is more than five times the width of the lapped joint 28. In some embodiments of the present invention, the layer 26 may be formed of the same material that forms the sheets that make up the liner 10.

With embodiments of the present invention, a highly stable, liquid penetration resistant seam may be formed without necessitating the labor intensive exercise of heat seaming adjacent sheets to one another. In addition, the use of the clay tends to be more simple since, once it is pressed onto the lapped joint 28, the clay tends to create an effective seal. This is at least in part due to the fact that the clay layer 24 used in the strip 22 hydrates when exposed to water and water-based mixtures. Thus, in some embodiments of the present invention, a lower cost seam may be produced which is at least as reliable as existing techniques.

Where the liner 12 is white surfaced to minimize thermal expansion, the layer 26 may also be white surfaced. The upper or lower surface of the layer 26 may also be textured.

While the present invention has been described with respect to a limited number of embodiments, those skilled in the art will appreciate numerous modifications and variations therefrom. It is intended that the appended claims cover all such modifications and variations as fall within the true spirit and scope of this present invention.

What is claimed is:

1. A method of lining an earthen area comprising:

covering said area with at least two substantially liquid impermeable liner sheets;

forming a seam between said sheets;

covering said seam with a layer including a liquid swellable clay; and covering said clay layer with a substantially liquid impermeable membrane.

2. The method of claim 1 including adhesively securing said membrane to said clay layer.

3. The method of claim 1 including covering said membrane with overburden.

4. The method of claim 1 wherein forming a seam includes forming a lapped seam.

5. The method of claim 1 including using a plastic liner sheet that is impermeable to liquids.

6. The method of claim 5 including using a high density polyethylene liner sheet.

7. A method comprising:

covering an area of earth with at least two substantially liquid impermeable sheets;

overlapping the edges of adjacent sheets to form a lapped joint; and covering the joint with a layer that includes a liquid swellable clay.

8. The method of claim 7 including covering the clay layer with a substantially liquid impermeable membrane.

9. The method of claim 8 including adhesively securing the membrane to the clay layer.

10. The method of claim 7 including covering the sheets and clay layer with overburden.

11. The method of claim 7 including forming a lapped joint that is between four and six inches in width.

12. The method of claim 7 including covering the joint with a clay layer that is between three and four feet in width.

* * * * *